United States Patent [19]

Whisman et al.

[11] 4,073,720

[45] Feb. 14, 1978

[54] METHOD FOR RECLAIMING WASTE LUBRICATING OILS

[75] Inventors: Marvin L. Whisman; John W. Goetzinger; Faye O. Cotton, all of Bartlesville, Okla.

[73] Assignee: The United States of America as represented by the United States Department of Energy, Washington, D.C.

[21] Appl. No.: 734,838

[22] Filed: Oct. 22, 1976

[51] Int. Cl.[2] ..... C10M 11/00

[52] U.S. Cl. ..... 208/180; 208/181; 208/184

[58] Field of Search ..... 208/180, 181, 184

[56] References Cited

U.S. PATENT DOCUMENTS

| | | | |
|---|---|---|---|
| 1,766,768 | 6/1930 | Werkenthin | 208/180 |
| 2,270,837 | 1/1942 | Jones | 208/180 |
| 3,639,229 | 2/1972 | Brownawell et al. | 208/184 |
| 3,763,036 | 10/1973 | Jordan et al. | 208/180 |
| 3,819,508 | 6/1974 | Fainman et al. | 208/180 |

*Primary Examiner*—Delbert E. Gantz
*Assistant Examiner*—James W. Hellwege
*Attorney, Agent, or Firm*—Dean E. Carlson; Frank H. Jackson; James W. Weinberger

[57] ABSTRACT

A method for purifying and reclaiming used lubricating oils containing additives such as detergents, antioxidants, corrosion inhibitors, extreme pressure agents and the like and other solid and liquid contaminants by preferably first vacuum distilling the used oil to remove water and low-boiling contaminants, and treating the dried oil with a solvent mixture of butanol, isopropanol and methylethyl ketone which causes the separation of a layer of sludge containing contaminants, unspent additives and oxidation products. After solvent recovery, the desludged oil is then subjected to conventional lubricating oil refining steps such as distillation followed by decolorization and deodorization.

6 Claims, No Drawings

METHOD FOR RECLAIMING WASTE LUBRICATING OILS

CONTRACTUAL ORIGIN OF THE INVENTION

The invention described herein was made in the course of, or under, a contract with the U.S. Energy Research and Development Administration.

BACKGROUND OF THE INVENTION

This invention relates to an improved method for the refining of hydrocarbon oils. More specifically, this invention relates to an improved pretreatment method for the reclaiming of used lubricating oils by the removal of solid and liquid impurities contained therein.

Critical shortages of petroleum have focused attention on ways and means of conserving dwindling supplies of crude oil and petroleum products until science and technology can close the gap with stimulated production, alternative energy sources and more efficient energy utilization. One approach to this problem has been to encourage better utilization of present supplies, which includes an estimated 1 billion gallons of used lubricating oil that is drained, dumped or burned each year in this country. These oils have generally been used as engine crankcase lubricants, transmission and gear oils and the like. These oils commonly contain various detergents and extreme pressure additives such as polyvalent metal soaps as well as impurities which result from oxidation of the oil itself, water and gasoline. Much of this oil could be reused if collected and effectively reprocessed. Instead, as much as one-third of it is indiscriminately dumped, contaminating both water and land. Some is burned and this, too, contributes to pollution of our environment by releasing metallic oxides into the atmosphere. These metallic contaminants originate, for the most part, from lubricant and fuel additives necessary for satisfactory engine performance.

Many processes are available for the purification and reprocessing of lubricating oils. Often these processes involve the use of distillation followed by polishing or decolorizing treatment. However, to prevent coking and column fouling during distillation, some form of pretreatment to remove many of the additives and contaminants from the oil is preferred. Some of these treatments are severe, oftentimes altering the petroleum base composition of the lubricating oil and resulting in the loss of a substantial quantity of otherwise recoverable organic material and ultimately producing a product deficient in properties required in high-quality lubricants.

Typically, the used oil is heated to drive off volatile hydrocarbons and water and to permit some of the solids to settle before adding a strong mineral acid which precipitates out a large portion of the oil as sludge. The supernatant oil is separated from the sludge, neutralized with a caustic and distilled or further treated with clay and filtered.

Other processes may utilize a caustic such as sodium hydroxide rather than an acid, but in either process a large percentage of the used oil is lost (up to about 50%) and large quantities of an acidic or caustic sludge remain which are increasingly difficult to dispose of due to environmental considerations. Additionally, severe treatments of the acid or caustic type result in a substantial loss of diaromatic and polyaromatic-polar materials from the oil which may approach 70% on an original oil basis. These higher molecular weight aromatics are generally associated with natural lubricity characteristics of the base oil and removal of these compounds would affect this parameter of the lubricant product. Likewise, the polar materials are responsible in part for natural resistance to oxidation, and selective removal of these compounds will contribute to poor oxidation stability of reprocessed lubricating oils. Both of these conditions can be overcome, to some extent, by the use of additives.

Still other treatment processes have been developed in an attempt to meet the environmental objections of the previous processes, by utilizing various hydrocarbon liquid diluents which may be also combined with solvents such as alcohol or water-alcohol mixtures to form solvent precipitation mixtures. While these processes do not result in a loss of the desirable aromatic compounds, neither do most of these solvent processes remove sufficient contaminants from the waste oil and so must be combined with additional steps which utilize an acid or other more severe treatment.

However, none of these processes appears to be able to remove only the undesirable used and unused additives and other solid and liquid contaminants from the used lubricating oil while leaving unchanged the desirable lubricity and anti-oxidant properties of the petroleum base.

SUMMARY OF THE INVENTION

We have developed a pretreatment process for purifying and reclaiming waste lubricating oils which produces high recovery yields of highly purified oil and which does not result in an environmentally objectionable by-product. In accordance with the method of our invention for reclaiming waste lubricating oil, the oil after separation of low-boiling components is combined with a solvent mixture of 2-propanol, methylethyl ketone and 1-butanol, whereby the oil dissolves in the solvent while metal compounds and oxidation products present in the used oil precipitate out as sludge. The purified oil-solvent mixture is separated from the sludge and the purified oil is then separated from the solvent mixture which may then be recycled. The purified oil is then reprocessed and reformulated as a fresh lubricating oil.

The process of this invention has a number of advantages over prior art processes for reclaiming waste oils. For example, it was found that good results were attainable with a solvent to waste oil ratio of 3 to 1 while most prior art methods require at least 4 and up to 8 to 12 parts solvent to 1 part oil.

The sludge which is recoverable from the process of this invention contains no added caustic or acids and hence is not objectionable from an environmental standpoint as are the sludges which result from the many purification processes which utilize acids or caustics. The sludge is high in metals, particularly lead so that commercial metal recovery may prove to be feasible. The sludge, because it has a neutral pH, can be readily used as a road asphalt or for a similar purpose.

It is therefore one object of this invention to provide an improved method for the purification of waste lubricating oils.

It is a further object of the invention to provide an improved method for purifying waste lubricating oils which gives increased yields of oil, while utilizing less solvents than prior art methods.

Finally, it is the object of this invention to provide an improved method for purifying waste lubricating oils which produces a sludge which is environmentally compatible and is useful as a by-product of the purification treatment.

DESCRIPTION OF THE PREFERRED EMBODIMENT

These and other objects of the invention for reclaiming waste lubricating oil may be met by vacuum-distilling the waste lubricating oil to strip the water and volatile materials, such as gasoline boiling below about 600°-700° F (315°-371° C) from the waste oil, combining the stripped oil with a solvent mixture in a ratio of about 1 part oil to 3 parts solvent mixture, the solvent mixture containing 1 part 2-propanol, 1 part methylethyl ketone and 2 parts 1-butanol, whereby the oil dissolves in the solvent mixture and oxidation products, additives, metal compounds and other impurities in the oil precipitate out as a sludge, separating the purified oil-solvent mixture from the precipitate and the purified oil separated and recovered from the solvent mixture.

Preferably, the used lubricating oil is subjected to a distillation step in order to remove water and other volatile hydrocarbons boiling below 600°-700° F (315°-371° C) which may be present in the oil, in order to prevent formation of azeotropes with the solvent mixture which may later hinder solvent recovery. Stripping may be accomplished by any efficient method such as, for example, vacuum distillation where a temperature of about 300°-345° F (174° C) at a pressure of about 2-10 mm Hg will provide sufficient stripping of water and volatile hydrocarbons from the oil.

The preferred solvent composition is 1 part 2-propanol (isopropyl alcohol), 1 part methylethyl ketone to 2 parts 1-butanol (n-butyl alcohol), although the amount of each component present in the solution may vary by up to about 10% by volume without unduly affecting the results attainable by the use of the solvent of the invention.

The solvent-to-used-lubricating-oil ratio may vary from about 8 to about 3 parts solvent to 1 part oil while the ratio is preferably from 4 to 3 parts solvent, and most preferably 3 parts solvent, to 1 part oil.

It is preferable that contact between the solvent mixture and the used oil take place at ambient temperature or below. Lower temperatures, down to about 50° F (10° C), will increase the effectiveness of the solvent by causing precipitation of more of the undesirable sludge and combustion products while temperatures higher than about 86°-140° F (30°-40° C) will reduce the effectiveness.

Generally, about 10% of the weight of the oil is precipitated by the solvent mixture. The solvent-oil mixture may be separated from the precipitate by any of the usual separation methods. For example, the mixture may be allowed to settle in a tank overnight followed by decantation of the solid-oil mixture. Alternatively, a centrifuge can be used to separate the sludge from the solvent-oil mixture immediately after mixing. The centrifuge might be used to provide either a continuous separation or a batch separation of sludge.

Recovery of the solvent mixture from the purified oil may be accomplished by any method known to those skilled in the art. For example, an evaporator/stripper with a suitable vacuum system and cold traps are suitable for solvent removal and recovery. In pilot-scale studies, effective solvent stripping was accomplished using a continuous-feed distillation column operated at 150 mm Hg abs. at 345° F (174° C). These conditions left about 0.1% of the solvent in the oil so that a second pass through the column at 1 mm Hg abs. was used to improve solvent recovery. The recovered solvent can then be reused to purify additional dehydrated waste oil, while the purified oil separated from the solvent is processed further.

Additional processing of the solvent-stripped purified oil will be necessary in order to prepare the oil for reuse as a lubricant. For example, the oil may be vacuum-distilled either fractionally or by taking a full boiling range oil distillate overhead. The distillate may be subjected to light hydrogenation or alternatively it may be treated with a bleaching clay and dry steam at 250° to 450° F (121°-232° C) for a short period of time to decolor and deodorize the oil. At this time the purified oil may be blended with a suitable group of new additives to prepare it for reuse as a lubricating oil.

The following example is given to illustrate the process of the invention and is not to be taken as limiting the scope of the invention which is defined by the claims appended hereto.

EXAMPLE

A portion of used lubricating oil amounting to about 4 liters was heated to 300° F (184° C) under a pressure of 10 mm Hg to remove light hydrocarbons and water. (Typical used lubricating oil feedstocks yield in the range of 5% light hydrocarbons and 5% water.) One part of oil (2770 ml) of this dehydrated oil was subsequently mixed with 3 parts (8310 ml) of solvent and allowed to settle for 24 hours. The solvent consisted of 1 part isopropyl alcohol, 1 part methylethyl ketone and 2 parts n-butyl alcohol. The oil-solvent phase was separated from the precipitated sludge, and transferred to a distillation column where the solvent was removed. The first stripping of solvent was performed at 300° F (184° C) liquid temperature and atmospheric pressure. To insure complete removal of solvent, the last stage of the distillation was conducted at 300° F (184° C) liquid temperature and 10 mm external pressure. Solvent recovery amounted to 7,995 ml (96.2%), 2330 ml (84.1%) of treated oil was recovered, while the sludge amounted to 440 (15.9%) of the total. Subsequent fractionation of this solvent-treated oil in a wiped film evaporator produced four fractions ranging in viscosity from 71.5 to 1082 SUS as shown in Table I.

TABLE I

| Fractionation Condition and Yields | | | |
|---|---|---|---|
| Fraction Viscosity, SUS at 100° F | Yield, % | Distillation Conditions Temp., ° C* | Pressure |
| 71.5 | 17.52 | 290 | 5 mm Hg |
| 178.8 | 29.04 | 190 | 10 um Hg |
| 459 | 26.33 | 270 | 10 um Hg |
| 1082 | 11.38 | 350 | 10 um Hg |

*Wiped surface temperatures.

Overall oil recovered from this run was 70.88% based upon the initial dehydrated oil charge and adjusted for sampling.

Physical and chemical properties of the recovered oil are shown in Table II.

TABLE II

| | Physical and Chemical Properties of Oils | | | | | |
|---|---|---|---|---|---|---|
| | Dehydrated Feed | Solvent treated Oil | Distillation Fractions 71.5 SUS | 178.8 SUS | 459 SUS | 1082 SUS |
| Ash, % | 1.10 | 0.36 | 0.00 | 0.00 | 0.00 | 0.00 |
| Acid No. | 3.36 | 1.44 | 1.35 | 0.30 | 0.21 | 0.19 |
| Saponification No. | 11.9 | 7.54 | 9.02 | 5.09 | 2.32 | 5.50 |
| Sulfur, % | 0.41 | 0.26 | 0.23 | 0.17 | 0.16 | 0.22 |
| Carbon residue, Ramsbottom % | 2.86 | 1.58 | 0.31 | 0.25 | 0.28 | 0.46 |
| Pb, ppm | 4560 | 250 | 3 | 3 | 0 | 10 |
| Zn | 660 | 370 | 0 | 0 | 0 | 5 |
| Ca | 1170 | 550 | <10 | <10 | <10 | <10 |
| Mg | 182 | 250 | 3 | 3 | 0 | 10 |
| Ba | 520 | 120 | <10 | <10 | <10 | <10 |
| Na | 100 | 140 | 2 | 2 | 2 | 3 |
| Al | 11 | 6 | 2 | 1 | 0 | 1 |
| Cr | 8 | 6 | 2 | 1 | 0 | 2 |
| Cu | 18 | 12 | 0 | 0 | 0 | 0 |
| Fe | 179 | 80 | 0 | 0 | 0 | 1 |

It can be seen from the preceding discussion that the invention provides an improved pretreatment process for the recovery of waste lubricating oils by increasing the amount of oil recovered, producing a smaller quantity of an environmentally safe and useful waste sludge product and by producing a desludged oil product which requires only a minimal amount of additional reprocessing to prepare the oil for reuse as a lubricant.

The embodiments of the invention in which an exclusive property or privilege is claimed are defined as follows:

1. In a process for reclaiming used lubricating oil wherein the oil is stripped of water and volatile constituents and subsequently subjected to conventional lubricating oil refining steps, the improvement which comprises removal of sludge components of the used oil by contacting the oil with a solvent mixture consisting of about 1 part 2-propanol, about 1 part methyl ethyl ketone and about 2 parts 1-butanol following the stripping step and prior to the conventional refining steps whereby the oil dissolves in the solvent and the sludge components precipitate out.

2. The process of claim 1 wherein from 3 to 8 parts solvent mixture are contacted with 1 part used oil.

3. The process of claim 2 wherein the subsequent refining step includes vacuum distillation.

4. A method for purifying used lubricating oils containing detergents, extreme pressure additives and oxidation products and other contaminants comprising:

a. vacuum-distilling the used oil to strip $H_2O$ and volatile materials boiling below 600°–700° F;

b. mixing the stripped oil with a solvent mixture consisting of about 1 part 2-propanol, about 1 part methyl ethyl ketone and about 2 parts 1-butanol, whereby the oil dissolves in the solvent and the additives and oxidation products precipitate out as a sludge;

c. separating the purified oil-solvent mixture from the sludge;

d. separating the purified oil from the solvent mixture; and e. subjecting the purified oil to conventional refining steps.

5. The process of claim 4 wherein 3 to 4 parts of solvent mixture are contacted with 1 part stripped used oil.

6. The process of claim 5 wherein the conventional refining step includes vacuum distillation.

* * * * *